US008587455B2

(12) United States Patent
Porte et al.

(10) Patent No.: US 8,587,455 B2
(45) **Date of Patent: *Nov. 19, 2013**

(54) LOCALISATION OF VEHICLE OR MOBILE OBJECTS BASED ON EMBEDDED RFID TAGS

(75) Inventors: Philippe Porte, Aix en Provence (FR); Pierre Bonnefoy, Ceyreste (FR)

(73) Assignee: Psion, Inc., Mississauga, Ontario (CA)

( * ) Notice: Subject to any disclaimer, the term of this patent is extended or adjusted under 35 U.S.C. 154(b) by 1062 days.

This patent is subject to a terminal disclaimer.

(21) Appl. No.: 12/604,658

(22) Filed: Oct. 23, 2009

(65) Prior Publication Data

US 2010/0039293 A1 Feb. 18, 2010

Related U.S. Application Data

(63) Continuation of application No. 11/323,638, filed on Dec. 30, 2005, now Pat. No. 7,609,175.

(51) Int. Cl.

| | |
|---|---|
| ***G08G 1/01*** | (2006.01) |
| ***G08G 1/065*** | (2006.01) |
| ***G08B 13/14*** | (2006.01) |

(52) U.S. Cl.
USPC ..... 340/933; 340/572.1; 340/572.7; 340/941

(58) Field of Classification Search
USPC ..... 340/933, 572.7
See application file for complete search history.

(56) References Cited

U.S. PATENT DOCUMENTS

| | | | | |
|---|---|---|---|---|
| 5,420,580 | A | 5/1995 | Rawls | |
| 6,040,774 | A | 3/2000 | Schepps | |
| 6,049,745 | A | 4/2000 | Douglas et al. | |
| 6,377,888 | B1 | 4/2002 | Olch | |
| 6,445,297 | B1 | 9/2002 | Nicholson | |
| 6,459,966 | B2 | 10/2002 | Nakano et al. | |
| 6,552,661 | B1 | 4/2003 | Lastinger et al. | |
| 6,653,946 | B1 * | 11/2003 | Hassett | 340/928 |
| 7,609,175 | B2 * | 10/2009 | Porte et al. | 340/933 |
| 2003/0201321 | A1 | 10/2003 | Maloney | |

OTHER PUBLICATIONS

Non Final Office Action mailed Sep. 17, 2008 in counterpart U.S. Appl. No. 11/323,638, Philippe Porte, filed Dec. 30, 2005.
Final Office Action mailed Mar. 16, 2009 in counterpart U.S. Appl. No. 11/323,638, Philippe Porte, filed Dec. 30, 2005.
Non Final Office Action mailed Sep. 17, 2008 in counterpart U.S. Appl. No. 11/323,638, Philipp Porte, filed Dec. 30, 2005.
Notice of Allowance mailed Jun. 12, 2009 in counterpart U.S. Appl. No. 11/323,638, Philippe Porte, filed Dec. 30, 2005.
Office Action for counterpart Canadian Patent Application No. 2531939 mailed on May 29, 2008.
Office Action for counterpart Canadian Patent Application No. 2531939 mailed on Nov. 25, 2009.
Notice of Allowance for counterpart Canadian Patent Application No. 2531939 mailed on Jun. 27, 2011.

* cited by examiner

*Primary Examiner* — Donnie Crosland
(74) *Attorney, Agent, or Firm* — Randi L. Karpinia; Michael J. Giannetta

(57) ABSTRACT

An RFID system for determining the location of a vehicle or mobile object that passes thereover is presented. The system comprises a tag arrangement having at least one tag where the arrangement having a width of between approximately 0.5 m and 2 m.

13 Claims, 3 Drawing Sheets

LOCALISATION OF VEHICLE OR MOBILE OBJECTS BASED ON EMBEDDED RFID TAGS

FIELD OF INVENTION

The present invention generally relates to a system for determining the location of vehicles and more particularly relates to an Radio Frequency Identification (RFID) based system.

BACKGROUND OF THE INVENTION

RFID systems are well suited to determining the location of vehicles. In such systems the vehicle may have a tag located therein where the vehicle passes readers at particular locations or it may have a reader located therein and there are tags at fixed locations. In systems of the latter type the tags may be embedded in the surface over which the vehicle travels. Systems of the latter type are generally preferred where the vehicle is traveling within a fixed and/ or enclosed area.

In U.S. Pat. No. 6,049,745 a navigation system for an automatic guided vehicle is disclosed. Tags are embedded in a warehouse floor and a forklift having a reader located thereon is with use of the tags. In FIG. 1 of U.S. Pat. No. 6,049,745 tags are shown located along the centerline of the lane along which the forklift travels. It is further shown that the tags are more densely populated at the intersection of lanes allowing for realignment of the vehicle after a turn. With the use of a single tag along the centerline of a lane the disclosed system most readily provides for simple steering of the vehicle.

U.S. Pat. No. 6,377,888 discloses a system for controlling the movement of a vehicle that is free ranging within a defined area. In the disclosed system there are at least two RFID readers located in the vehicle and there is an array of tags embedded in the surface on which the vehicle travels. In one embodiment the tags are arranged such that only one of the tags is readable by a reader on the vehicle at any one time. It is further disclosed that a computer located in the vehicle receives location and acceleration data and calculates motion command signals for the vehicle. As disclosed between column 5, line 56 and column 6, line 12 the tags are of conventional construction.

U.S. Pat. No. 6,459,966 discloses a navigating method and device for an autonomous vehicle. An RFID reader is located on the vehicle and a row of tags is embedded in the floor. The reader has two antenna coils that are adjacent to one another and positioned left and right in the moving direction, column 6, lines 34-37. As shown in any of FIGS. 1-6 the beacons or tags are arranged in a single row. The trajectory of the vehicle is thereby determined by the positioning of the two antenna coils with respect to the row of tags.

The above systems are however not applicable to obtaining localization information for a freely traveling vehicle. In particular there is a need for determining localization information for a vehicle traveling along a track of limited width and be one of a plurality of adjacent tracks. In previous systems this problem was solved by scanning bar codes at the point of storage or by having the operator manually enter specific codes located on the floor.

SUMMARY OF THE INVENTION

The present invention relates to a system for determining the location of vehicle as it travels within a lane in a warehouse. The system is generally structured to provide a barrier over which a vehicle passes.

According to the present invention there is provided an RFID system for determining the location of a vehicle that passes thereover. The system comprising a tag arrangement having at least one tag, the arrangement having a width of between approximately 0.5 m and 2 m.

According to another aspect of the invention an RFID system for determining the location of a mobile object that passes thereover is provided, the system comprising a tag having a first antenna for RF communications for the reader, the first antenna being a coil antenna, and a second antenna having, a loop having a width the loop having a width of at least approximately 0.5 m, and a coil providing inductive coupling between the first and second antenna.

This summary of the invention does not necessarily describe all features of the invention.

BRIEF DESCRIPTION OF THE DRAWINGS

These and other features of the invention will become more apparent from the following description in which reference is made to the appended drawings wherein.

DETAILED DESCRIPTION

The following description is of a preferred embodiment.

The current embodiment considers a system for determining the location of a vehicle that is moving within a warehouse environment. Within such an environment vehicles often travel in lanes where the lanes are often sized to be slightly larger than the vehicles that travel along them. A particular lane along which the vehicle travels may be either a single lane or it may be a lane amongst two or more adjacent lanes. For the case where there are two or more adjacent lanes the system must be able to differentiate between a vehicle traveling in the lane in which the system is located and one traveling in an adjacent lane. Further the vehicles will often be traveling at high speeds.

Figure 1A:
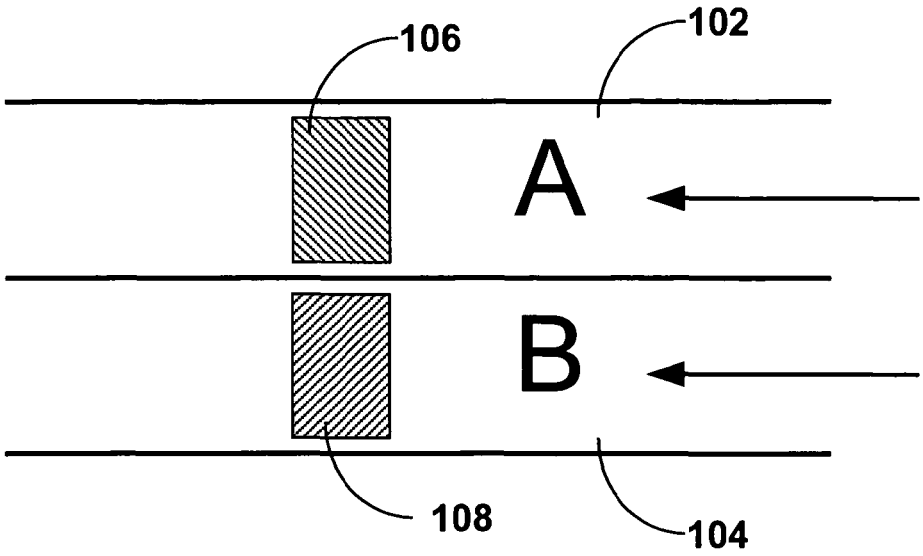
FIG. 1*a* shows a schematic diagram of a vehicle track lane in accordance with an embodiment of the present invention.

FIG. 1*a* is a schematic diagram of a section of two adjacent lanes i.e. lane A 102 and lane B 104, which are aligned parallel to one another for the sections shown in FIG. 1. The lanes 102 and 104 are both approximately 2 m wide. The width of the lanes A and B should in no way be considered limiting to the scope of this embodiment. Rather the system of the current embodiment can be configured to any lane dimensions above the minimum lane width where the minimum lane width is slightly larger than the width of the antenna that is attached to the vehicle traveling in the lane. In the current embodiment the antenna on the vehicle is 50 cm wide. Thus the lane should be at least approximately 60 cm wide to avoid spurious readings. There is no maximum lane width as the barrier can be designed to provide coverage for the entire lane.

The lanes 102 and 104 have barriers 106 and 108 located therein, respectively. These barriers are defined areas with a lane and are not continuous along the length of the lane. The barriers 106 and 108 each comprise at least one tag (not shown), which are read by a reader that is located within the vehicle that crosses over the barrier. The at least one tag is located within the floor wherein the floor surface is flush with the surrounding floor. The mounting of tags within a floor will be apparent to those of skill in the art where the current embodiment considers conventional forms of such mounting. The exact dimensions of the barrier with respect to the lane in which is located is only schematically shown in FIGS. 1*a* and 1*b*.

Figure 1B:
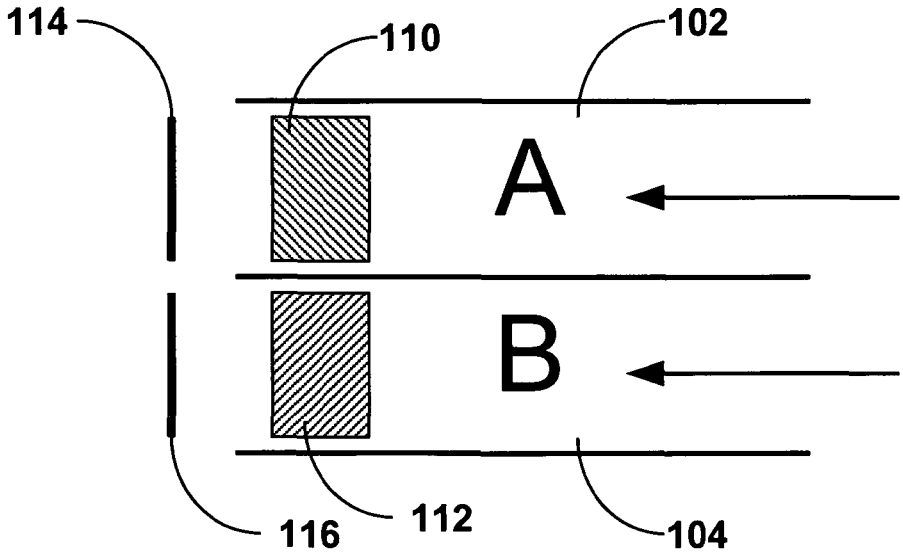
FIG. 1*b* shows a schematic diagram of a vehicle track lane in accordance with another embodiment of the present invention.

FIG. 1*b* depicts another configuration wherein the barriers 110 and 112 are located at the end of the lanes 102 and 104, respectively. Further, the barriers 110 and 112 are in front of storage locations 114 and 116, respectively. Storage locations 114 and 116 are appropriate for the storage of pallets that are transported by a forklift operating in lanes 102 and 104, respectively. The barriers 110 and 112 are located such that the RFID antenna on a forklift can detect the barrier while it is engaging a pallet at the storage location 114 and 116, respectively.

Figure 2:
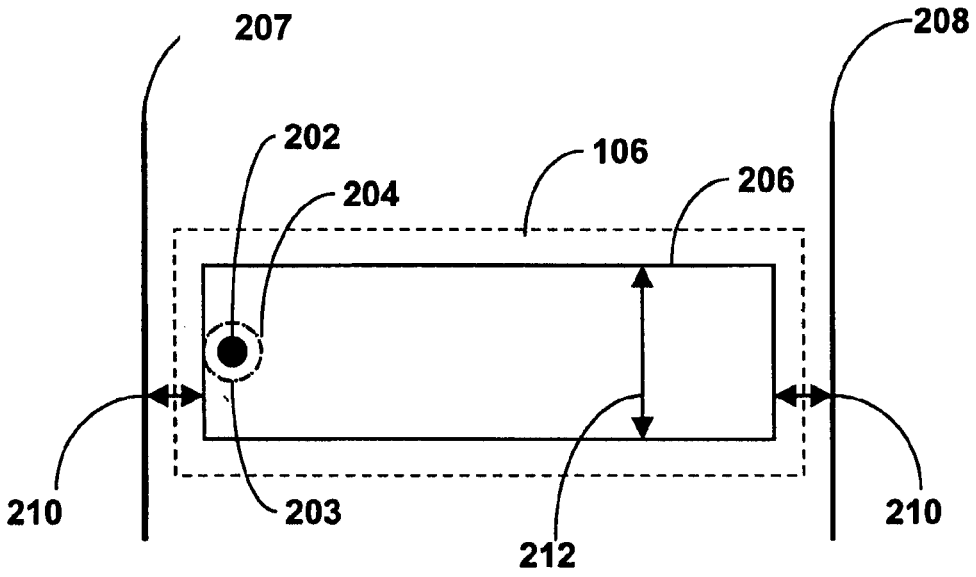
FIG. 2 shows a schematic diagram of a tag antenna arrangement in accordance with a further embodiment of the present invention.

FIG. 2 is a schematic diagram illustrating the currently preferred embodiment of tag arrangement within barrier 106. In this embodiment there is a single tag 202 located within the barrier 106. The tag 202 comprises a standard primary coil antenna 203, hatched line in FIG. 2, which provides for the communication of data to and from the tag 202. A secondary antenna is also used in this arrangement. The secondary antenna includes a coil 204, dotted line in FIG. 2, and a loop antenna 206. The coil 204 comprises a few turns that are the same size as tag antenna 203. The coil 204 is inductively coupled to the tag antenna 203. As such it provides for energy transfer between the primary antenna 203 and the loop antenna 206. Thus the coil 204 acts as an intermediary between the tag antenna 203 and loop antenna 206. The loop antenna 206 is a single wire loop that provides a large detection area.

The width 212 is determined by the maximum speed of the vehicle over the barrier wherein the presence of tag 202 can be detected within the time the vehicle is over the barrier 106. The spacing 210 between the loop 206 and the lane edges 207 and 208 is determined by the characteristics of the RFID antenna on the vehicle and the loop 206 such that the RFID antenna on the vehicle does not detect tags of a barrier adjacent to the one over which it is passing. In the current embodiment the spacing 210 is approximately 5 cm. The dimensions of the barrier 106 determine the dimensions of the loop antenna 206. Thus the loop antenna 206 provides coverage of the barrier 106.

Figure 3:
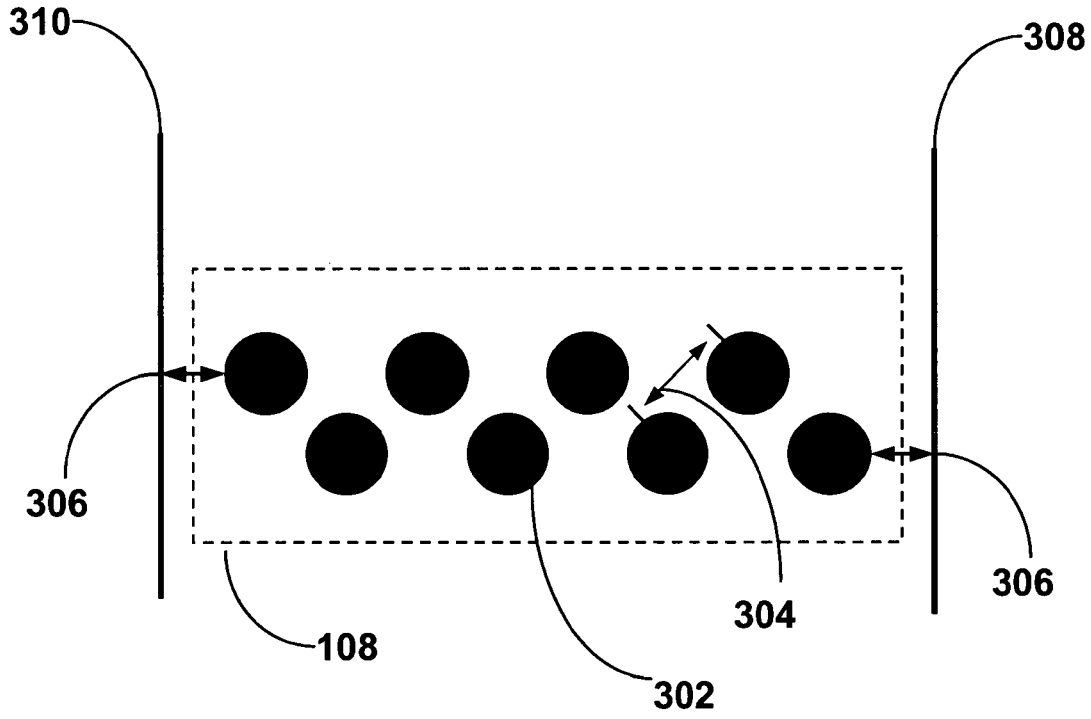
FIG. 3 shows a schematic diagram of a tag arrangement in accordance with a further embodiment of the present invention.

FIG. 3 presents an alternative embodiment where the barrier 108 has a plurality of tags located therein. Each tag 302 is a conventional tag with the tags 302 being arranged to form an array. The array is designed to provide RFID coverage within the bounds of the barrier 108. The tags 302 are arranged in a staggered pattern. The invention should not be limited to a particular layout of tags within the array. The particular arrangement will be a function of various properties including the type of tag, the capabilities of the RFID antenna mounted on the vehicle and the anticipated maximum speed of the vehicle.

As in the previous embodiment an RFID antenna of a fast moving vehicle must be able to detect the tags within the barrier 108. In addition to simple detection use of an array of tags within the barrier 108 allows for the speed and direction of travel for the vehicle to be determined.

Within the array the spacing 304 separates the tags 302. The spacing 304 is set such that there is always one tag visible to the RFID antenna on the vehicle. The minimum number of rows of tags in the direction of travel of the vehicle is 2, as shown in FIG. 3. This is also the minimum number of rows required for determination of speed and direction of the vehicle. The reliability of the barrier, with regard to its detection by the RFID antenna of the vehicle is increased with additional rows of tags 302. The use of additional rows of tags also increases the accuracy with which the speed and direction of the vehicle can be determined. The spacing 306 between the lane edges 308 and 310 is again set such that the vehicle passing over the barrier 108 does not detect tags in the adjacent barrier.

The tags 302 are standard tags in that they are not specifically designed for this application. In order to calculate the required information the tags 302 will have identification information encoded therein. In the current embodiment this information includes the track number i.e. the track in which the barrier containing the tag is located and a tag number in the array. In the current embodiment there is only one barrier per track such that identification of the barrier identifies the track.

During operation a vehicle will pass over the barrier 108. As it passes over barrier 108 the RFID antenna located thereon will send out a signal to which the tags 302 will respond. With the detection of the first tag the position of the vehicle can be determined. Identification of the tags that subsequently respond to the signal sent by the antenna will allow for directional information to be determined. Further with the addition of the time between tag detection the speed of the vehicle can be determined.

The localization information is coupled to a bar code scanned on the handling unit allowing it to be traced automatically, the fork lift driver is identified by a personal smart card, the handling unit, the exact positioning, the date and time.

The RFID system of the current embodiment operates at 13.56 MHz. This frequency has been selected as it offers a balance between speed detection and being able to operate without interference from the floor finish. This balance allows for the provision of the desired operating information in a warehouse environment. A system operating at 125 kHz would encounter a speed limit above which the tag would not be detected while a system operating at 800 MHz would be susceptible to the floor finish.

The embodiments of the invention are designed to provide "on the fly" reading, automatic data capture, very fast data capture, reliability of data capture, the localization information is coupled to the bar code scanned on the handling unit: thus it is possible to automatically trace the fork lift driver, the handling unit, the exact positioning and the date and time.

In an alternative embodiment of the invention the vehicle may be a fork lift or any other vehicle that may be found in a warehouse. The vehicle may also be a mobile object including a trolley or mobile carrier and the like.

The present invention has been described with regard to one or more embodiments. However, it will be apparent to persons skilled in the art that a number of variations and modifications can be made without departing from the scope of the invention as defined in the claims.

What is claimed is:

1. A system for determining a location of a vehicle, comprising:

a tag arrangement arranged within a lane, the tag arrangement comprising a plurality of radio frequency identification (RFID) tags with each RFID tag including information for determining the location of the vehicle and further comprising:

a first antenna for RF communications; and a second antenna for defining coverage of a tag reader for the RFID tag, the tag reader located on the vehicle, and the second antenna having a size larger than that of the first antenna so that the tag reader on the vehicle communicates with the RFID tag via the second antenna when the vehicle passes over the second antenna.

2. A system according to claim 1, wherein the tag arrangement comprises:

a coil for inductively coupling the first antenna and the second antenna, for transferring energy between the first antenna and the second antenna.

3. A system according to claim 1, wherein the system comprises a plurality of tag arrangements, each having the RFID tag and the second antenna and being arranged within a corresponding lane so that the RFID coverage is located within the corresponding lane without overlapping an RFID coverage of another tag arrangement in another lane.

4. A system according to claim 1 wherein the second antenna comprises:

a loop antenna.

5. A system according to claim 4, where the loop antenna is rectangular in shape.

6. A system according to claim 4, wherein the loop antenna is made from a single wire.

7. A system according to claim 2 wherein the first antenna comprises:

a coil antenna having substantially the same size as the coil.

8. A system according to claim 1, wherein the tag arrangement is embedded in a floor.

9. A system according to claim 1 wherein the tag arrangement has a width of between 0.5 m and 2 m.

10. A system according to claim 4, wherein the width of the loop antenna is at least 0.5 m.

11. A system according to claim 1 wherein the tag arrangement comprises the plurality of RFID tags, each having the first antenna and the information and being arranged in the shape of an array.

12. A system according to claim 11, comprising:

means for detecting at least one of a speed and direction of the vehicle based on the sequence of the plurality of RFID tags detected by the tag reader.

13. A system according to claim 11, wherein the spacing between the RFID tags is determined so that one RFID tag is visible by the tag reader.

* * * * *